US012714903B2

(12) United States Patent
Parsons et al.

(10) Patent No.: US 12,714,903 B2
(45) Date of Patent: Aug. 25, 2026

(54) CERVICAL STRENGTHENING AND REHABILITATION SYSTEM

(71) Applicant: MENARD CHIROPRACTIC HEALTH CENTER, INC., Fall River, MA (US)

(72) Inventors: Jessica L. Parsons, Fall River, MA (US); Lawrence Goodstein, Seekonk, MA (US); David W. Parsons, Jr., New Bedford, MA (US)

(73) Assignee: MENARD CHIROPRACTIC HEALTH CENTER, INC., Fall River, MA (US)

( * ) Notice: Subject to any disclaimer, the term of this patent is extended or adjusted under 35 U.S.C. 154(b) by 199 days.

(21) Appl. No.: 18/370,947

(22) Filed: Sep. 21, 2023

(65) Prior Publication Data

US 2024/0091583 A1 Mar. 21, 2024

Related U.S. Application Data

(60) Provisional application No. 63/408,590, filed on Sep. 21, 2022.

(51) Int. Cl.
*A63B 21/00* (2006.01)
*A42B 3/22* (2006.01)

(52) U.S. Cl.
CPC ..... *A63B 21/4003* (2015.10); *A42B 3/22* (2013.01); *A63B 21/00043* (2013.01)

(58) Field of Classification Search
CPC ..... A63B 21/4003; A63B 21/00043; A63B 17/02; A63B 21/00061; A63B 2208/0233; A63B 2209/10; A63B 21/0557; A63B 21/0442; A63B 21/0552; A63B 21/16; A63B 23/025; A63B 21/02–0414; A42B 3/22; A42B 3/04
See application file for complete search history.

(56) References Cited

U.S. PATENT DOCUMENTS 1,517,147 A * 11/1924 Burnett ..... A63B 23/025 482/129
3,156,239 A * 11/1964 Uribe ..... A61H 1/0218 482/10
4,537,393 A * 8/1985 Kusch ..... A63B 23/025 482/129
4,645,198 A * 2/1987 Levenston ..... A63B 23/025 482/10

(Continued)

FOREIGN PATENT DOCUMENTS

CA 2852446 C * 12/2017 ..... A63B 71/10
WO WO-2022056058 A1 * 3/2022 ..... A63B 21/0435
ZA 200902324 A * 1/2010 ..... A63B 21/06

*Primary Examiner* — Nyca T Nguyen
(74) *Attorney, Agent, or Firm* — Panitch Schwarze Belisario & Nadel LLP

(57) ABSTRACT

A cervical strengthening and rehabilitation system includes a helmet having a plurality of attachment anchors distributed at different locations thereon, a frame defining an interior volume configured to receive the helmet in operation, and one or more resistance bands. Each of the one or more resistance bands has a first end selectively connectable to one of the plurality of attachment anchors on the helmet and an opposing second end selectively connectable to the frame.

18 Claims, 4 Drawing Sheets

(56) References Cited

U.S. PATENT DOCUMENTS 5,242,347 A * 9/1993 Keeton ..... A63B 21/063 482/142
5,984,836 A * 11/1999 Casali ..... A63B 21/4003 602/17
6,106,437 A * 8/2000 Brooks ..... A63B 23/025 601/39
6,599,257 B2 * 7/2003 Al-Obaidi ..... A61H 1/0296 601/39
7,104,926 B2 * 9/2006 Carlson ..... A63B 21/023 601/39
8,840,528 B2 * 9/2014 Zylstra ..... A63B 21/4025 482/121
9,272,177 B2 * 3/2016 Befeld ..... A63B 21/16
9,526,965 B2 * 12/2016 Gatherer ..... A63B 21/4003
9,789,350 B1 * 10/2017 Wu ..... A63B 21/0442
10,307,284 B2 * 6/2019 Sudell ..... A61F 5/042
11,040,240 B1 * 6/2021 Powers ..... A63B 21/4039
11,311,767 B1 * 4/2022 Boyd ..... A63B 21/0557
11,413,491 B2 * 8/2022 Hunt ..... A63B 21/4025
2004/0058780 A1 * 3/2004 Edgeton ..... A63B 21/055 482/137
2006/0157937 A1 * 7/2006 Belog ..... F41H 1/02 273/348.4
2007/0015642 A1 * 1/2007 Demeniuk ..... A63B 21/4035 482/124
2011/0060260 A1 * 3/2011 Siegler ..... A61F 5/02 602/18
2012/0117717 A1 * 5/2012 McGinn ..... A42B 3/326 2/243.1
2012/0202658 A1 * 8/2012 Menefee, Sr. ..... A63B 21/4005 482/124
2019/0201775 A1 * 7/2019 Requa ..... A42B 3/0473
2021/0106091 A1 * 4/2021 Glover ..... A63B 71/08

* cited by examiner

CERVICAL STRENGTHENING AND REHABILITATION SYSTEM

CROSS-REFERENCE TO RELATED APPLICATIONS

This application claims the benefit of U.S. Provisional Patent Application No. 63/408,590, filed on Sep. 21, 2022, entitled "Cervical Strengthening and Rehabilitation System," the entire contents of which are incorporated by reference herein.

BACKGROUND

Embodiments described herein relate generally to a strengthening and rehabilitation system, and more particularly, to a system and method designed for strengthening and rehabilitating the neck muscles and associated physiological structures.

The neck is one of the body's most flexible joints. Due to the mobility required of the neck, and the load the neck must carry, a complex arrangement of muscles, tendons, ligaments, and soft tissue are involved in supporting the head and absorbing shock in this area of the body. As part of the neck's normal daily function, neck movement includes rotation, flexion, extension, lateral bending, and combinations of all these movements. The neck muscles are easily strained if they are not sufficiently strong. Neck muscles are very susceptible to injury or other painful problems from a variety of sources, including jarring motion from motor vehicle accidents or contact sports, posture-related fatigue, and emotional stress.

When the head is suddenly jerked in one direction without warning, as in a motor vehicle accident, or in a contact sport, the neck muscles contract in spasm, which holds the muscle in a foreshortened position, and causes pain and interference with neck function and posture. When office workers sit for long hours at a desk or in front of a computer, they suffer neck fatigue due to improper posture, inactivity, and poor circulation, which can adversely affect a person's performance. Furthermore, many people store emotional tension in the neck, which can result in headaches, sleeplessness, and even spasm when the tension does not get released.

There are common techniques employed in the rehabilitation of spasm and general muscle tension. Isometric contraction (where the force exerted by the muscle matches the resistance offered and movement does not occur), has been shown to induce a relaxation in the antagonist muscle group, and lessen the degree of spasm. Isotonic contraction (where the force exerted by the muscle overcomes resistance and movement does occur), has been shown to retrain weak muscles to normality, increase circulation, and in effect flush inflammation and tension from a muscle. Neither approach calls for heavy loading. In all cases, the resistance is less than the muscle is capable of overcoming. Benefits accrue from light, repeated usage.

It is often difficult to consistently apply the light amounts of resistance needed for rehabilitation. Light resistance is generally not available in standard exercise equipment designed to build or bulk-up muscles.

One conventional system is a Thera-Band Wall System. This system uses a cervical exercise headband attachment. This attachment includes a rubberized headband with one metal ring to attach to various resistance bands. To move the band to the other side of the head to do a different exercise, the patient must remove the headband and reattach it to the head in a different position. The headband pulls hair out and becomes loose during exercises. Because of this, patients either avoid treatment or are inconsistent in exercising, and are also prone to injury, resulting in ineffective exercises and inconsistency in results.

A need has thus arisen for an exercise device for use on a daily basis to rehabilitate, develop, and strengthen the muscles of the neck and the surrounding area, affording the usage of both isometric and isotonic techniques, employing a safe, limited resistance.

A need has further arisen for an exercise device to allow neck injury sufferers to perform light exercise, either isometric or isotonic, especially with the injured muscle or its antagonist in isolation, to reduce spasm, relieve pain, and enable an injured patient to return to normal activities of daily living. As the injury heals, continued exercising, with slightly more resistance, employing complex movement, can be used to strengthen the surrounding muscles, improve posture, and help prevent recurrence of injury.

A need has further arisen for a simple, inexpensive, and safe device that can be used for rehabilitation and ongoing general neck wellness.

BRIEF SUMMARY

Briefly stated, one embodiment comprises a cervical strengthening and rehabilitation system including a helmet having a plurality of attachment anchors distributed at different locations thereon, a frame defining an interior volume configured to receive the helmet in operation, and one or more resistance bands. Each of the one or more resistance bands has a first end selectively connectable to one of the plurality of attachment anchors on the helmet and an opposing second end selectively connectable to the frame.

In one aspect, the frame includes one or more connection rails configured to receive the second ends of the one or more resistance bands. In a further aspect, at least one of the one or more connection rails is configured for positional adjustment.

In another aspect, the helmet includes a removable interior lining. In a further aspect, the helmet includes a plurality of removable interior linings. Each of the interior linings accommodates a different skull size.

In yet another aspect, each of the first and second ends of each of the one or more resistance bands includes a locking clip. In a further aspect, the locking clip is a carabiner clip.

In still another aspect, the plurality of attachment anchors includes at least one attachment anchor positioned on a left side of the helmet, at least one attachment anchor positioned on a right side of the helmet, at least one attachment anchor positioned on a front side of the helmet, and at least one attachment anchor positioned on a rear side of the helmet. In a further aspect, the plurality of attachment anchors further includes at least one attachment anchor positioned on a top side of the helmet.

In another aspect, the plurality of attachment anchors are eye bolts.

In yet another aspect, the helmet further includes a transparent protective visor configured to cover eyes of a patient wearing the helmet.

Another embodiment comprises a method for performing cervical strengthening and rehabilitation on a patient. The method includes providing the patient with a helmet having a plurality of attachment anchors distributed at different locations thereon, receiving the patient within an interior volume defined by a frame, attaching a first end of a first resistance band to one of the plurality of attachment anchors on the helmet and an opposing second end of the first resistance band to the frame, and instructing the patient to assume a first head position while wearing the helmet and while the first resistance band is attached to the helmet and the frame.

In one aspect the method further includes attaching a first end of a second resistance band to one of the plurality of attachment anchors on the helmet and an opposing second end of the second resistance band to the frame. In a further aspect, the first ends of the first and second resistance bands are attached to a common one of the plurality of attachment anchors on the helmet. In a still further aspect, the first end of the first resistance band is attached to an attachment anchor on a top side of the helmet and the first end of the second resistance band is attached to an attachment anchor on a side of the helmet different from the top side.

In another aspect, the frame includes one or more connection rails, and attaching the second end of the first resistance band to the frame includes attaching the second end of the first resistance band to one of the one or more connection rails. In a further aspect, the method further includes adjusting a position of the one of the one or more connection rails to which the first end of the first resistance band is attached.

In yet another aspect, the method further includes adjusting the helmet according to a skull size of the patient by placing a selected one of a plurality of differently sized removable interior linings into the helmet.

In still another aspect, the method further includes instructing the patient to assume a second head position different from the first head position while wearing the helmet and while the first resistance band is attached to the helmet and the frame.

BRIEF DESCRIPTION OF THE SEVERAL VIEWS OF THE DRAWINGS

The following detailed description of preferred embodiments will be better understood when read in conjunction with the appended drawings. For the purpose of illustration, there are shown in the drawings embodiments which are presently preferred. It should be understood, however, that the invention is not limited to the precise arrangements and instrumentalities shown.

In the drawings.

DETAILED DESCRIPTION

Figure 1A:
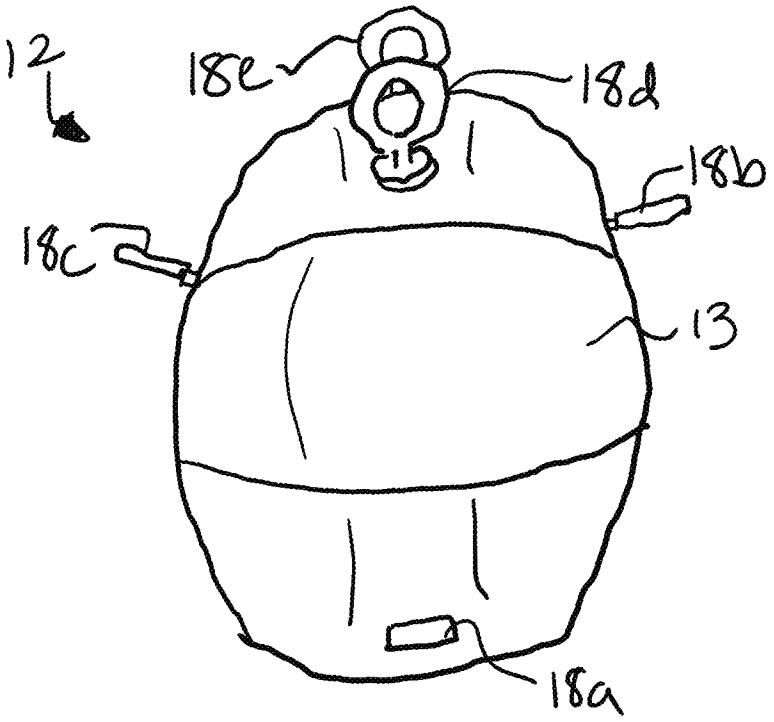
FIG. 1A is a front side elevational view of a helmet for use in the cervical strengthening and rehabilitation system according to an example embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the device and designated parts thereof. The terminology includes the above-listed words, derivatives thereof, and words of similar import. Additionally, the words "a" and "an", as used in the claims and in the corresponding portions of the specification, mean "at least one."

It should also be understood that the terms "about," "approximately," "generally," "substantially" and like terms, used herein when referring to a dimension or characteristic of a component, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 4:
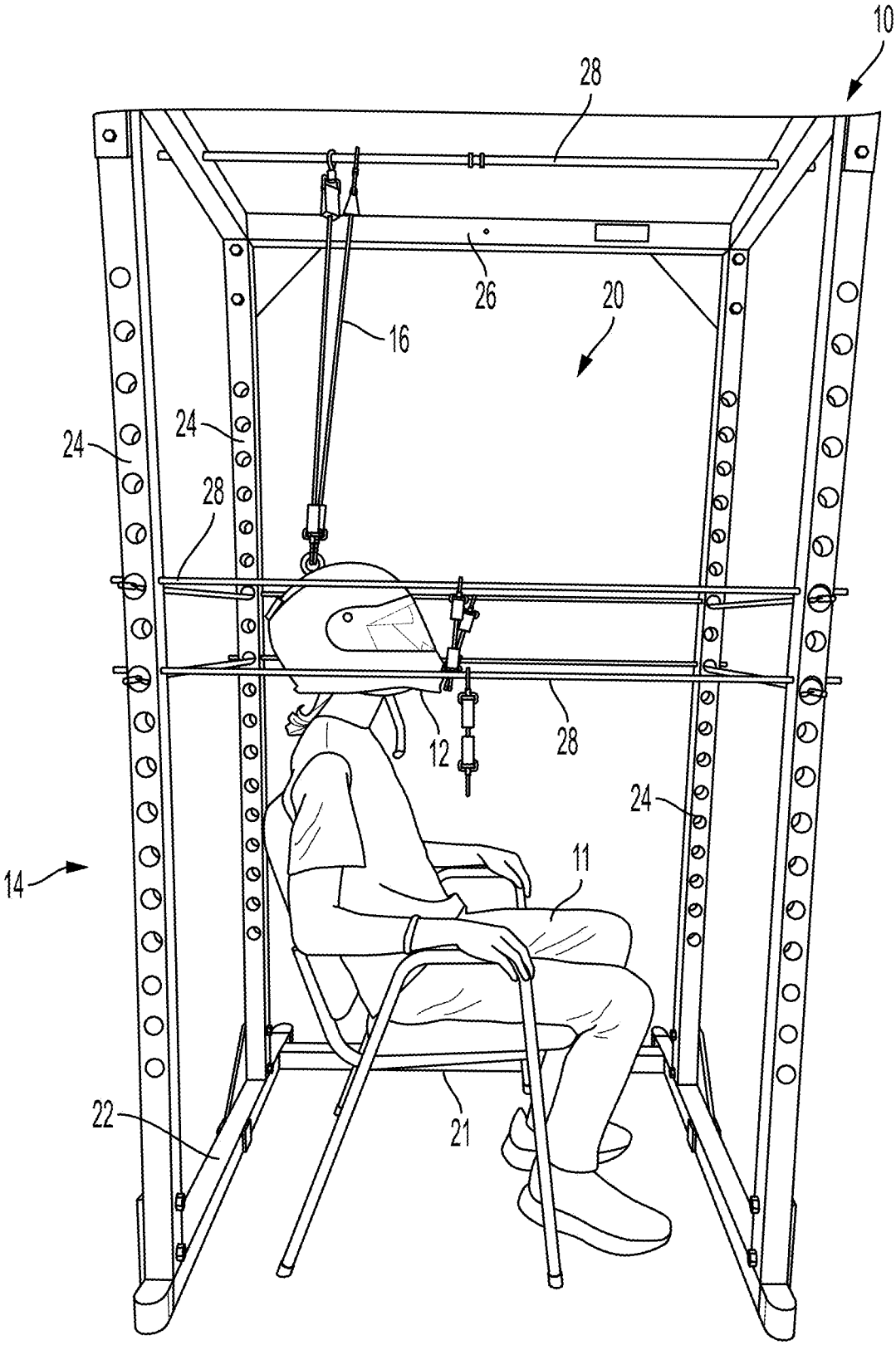
FIG. 4 is a right side elevational view of an example embodiment of the cervical strengthening and rehabilitation system, including a patient wearing the helmet of FIG. 1A.

Referring to FIG. 4, there is shown a cervical strengthening and rehabilitation system, generally designated as 10, in accordance with an example embodiment of the present invention. The system 10 may include a helmet 12, a frame 14, and one or more resistance bands 16.

Figure 1B:
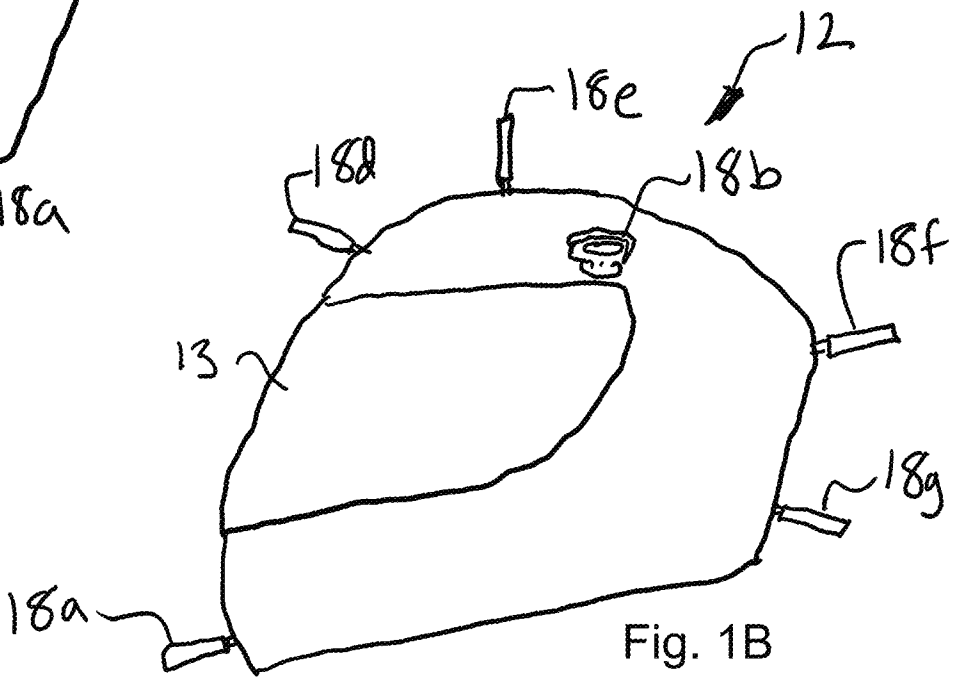
FIG. 1B is a left side elevational view of the helmet of FIG. 1A.

The helmet 12 may be configured to be received upon and enclose a large portion of a head of a patient 11. Referring to FIGS. 1A-1B, the helmet 12 not only provides one or more attachment points for the resistance bands 16 for performing various strengthening and rehabilitation exercises, but also may preferably provide protection against hazards caused by broken or erroneously connected resistance bands 16 to prevent injury to the face. Accordingly, the helmet 12 may be made from lightweight, impact-resistant materials, such as composite materials (e.g., carbon fibers or the like), fiberglass, plastic, or the like. To allow the patient 11 to see through the helmet 12, a visor 13 may be provided. The visor 13 may be optically transparent or translucent but made from similar impact-resistant material, such as polycarbonate or the like, to prevent eye injury from breakage or erroneous usage of the resistance bands 16. The visor 13 may be fixed in place on the helmet 12 to provide continuous protection of the eyes during usage of the helmet 12, but in some embodiments it may be desirable that the visor 13 be movable with respect to the helmet 12. In still other embodiments, instead of a visor 13, the helmet 12 may include one or more slits, gratings, a cage, or other like openings that permit a degree of vision by the patient 11 but are small enough to prevent contact with the patient's face by the resistance bands 16 or other large objects.

Figure 2:
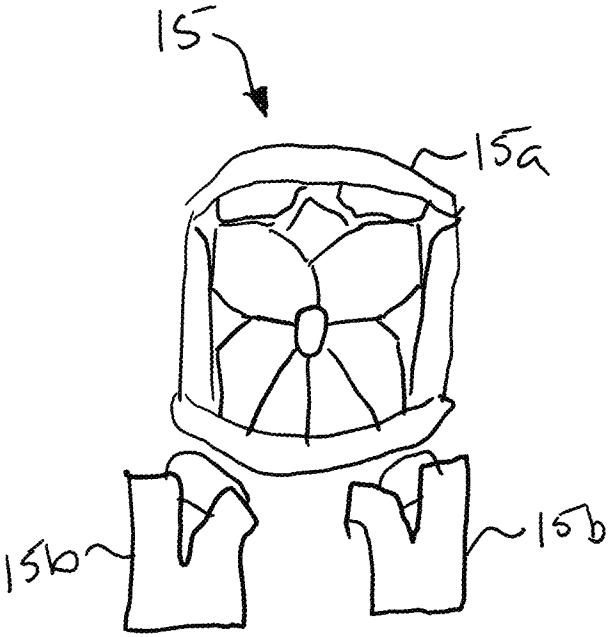
FIG. 2 is an exploded schematic view of a liner for use with the helmet of FIG. 1A.

Referring to FIG. 2, the helmet 12 may include an interior lining 15 configured to be maintained within an interior of the helmet 12 and configured to contact the head and/or face of the patient 11 for comfort, support of the helmet, extra safety protection, and the like. The interior lining 15 is therefore preferably made from a comfortable material, such as foam, padded fabric, or the like. In some embodiments, the lining 15 may form a single piece, but as shown in FIG. 2, the lining 15 may be provided in multiple pieces, such as a crown lining 15*a* and cheek linings 15*b*. However, other shapes and configurations are possible as well. The lining 15 may be removable from the helmet 12 for cleaning, replacement, or the like. For example, the lining may be retained in the helmet 12 via hook-and-loop fasteners, mechanical fasteners, snaps, or the like. In some embodiments, the helmet 12 may include a plurality of linings 15 that are removable and selectable for accommodating different skull sizes of patients 11.

Referring again to FIGS. 1A-1B, the helmet 12 may include a plurality of attachment anchors 18 distributed at different locations thereon. The attachment anchors 18 are shown in the drawings in the form of eye bolts, although other shapes and/or configurations for attaching resistance bands 16 to the helmet 12 may be used as well. This may include threaded openings (not shown), for example. In the embodiment shown in FIGS. 1A-1B, the helmet 12 includes two attachment anchors 18*a*, 18*d* on the front side, one attachment anchor 18*b* on the left side, one attachment anchor 18*c* on the right side, one attachment anchor 18*e* on the top side, and two attachment anchors 18*f*, 18*g* on the rear side. The top side anchor 18*e* may be used for stabilization of the helmet 12 during operation, although the top side anchor 18*e* may be used for other purposes as well. In some embodiments, the helmet 12 may include at least one attachment anchor 18 on each of the aforementioned sides, although other placements and arrangements of attachment anchors 18 may be utilized as needed for performing the strengthening and rehabilitation exercises for which the system 10 is to be utilized.

Figure 5:
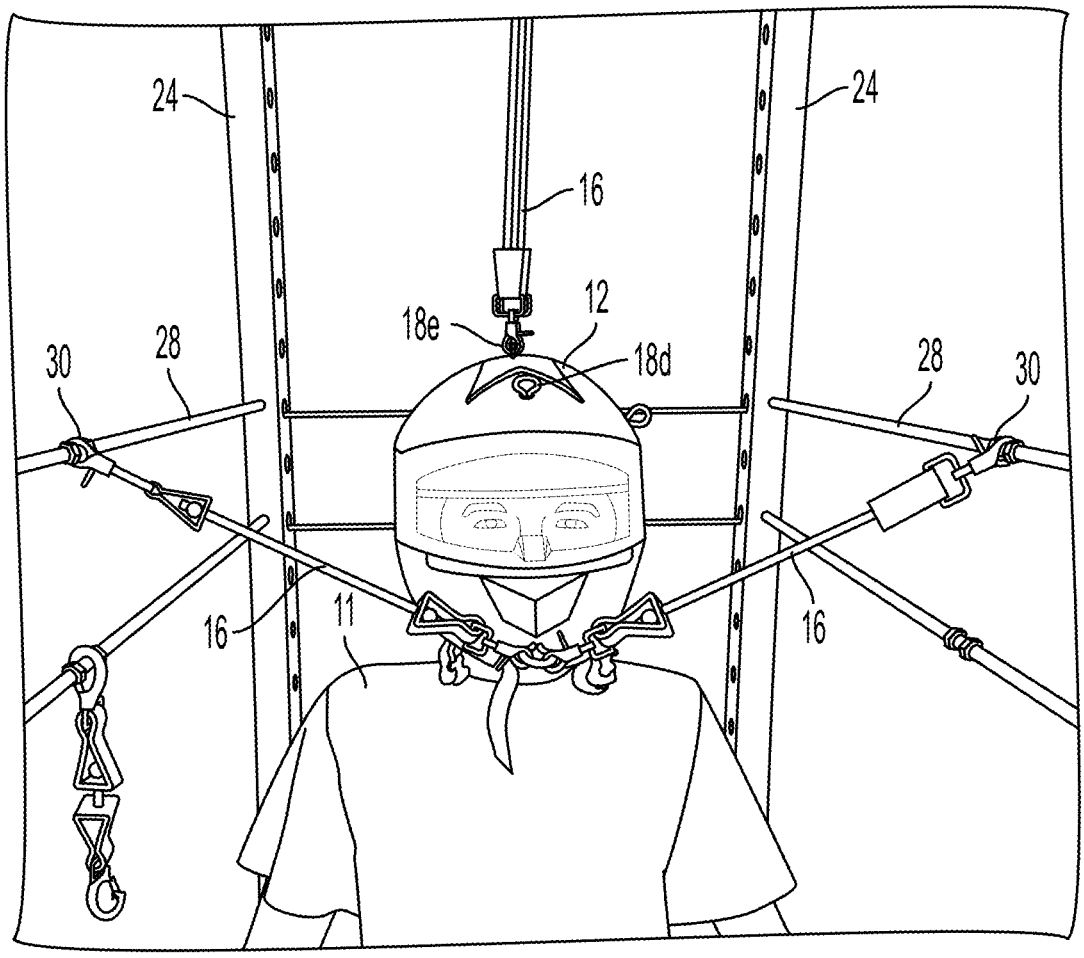
FIG. 5 is a partial, enlarged front side elevational view of the system of FIG. 4 including the patient.

Referring to FIGS. 4 and 5, the frame 14 defines an interior volume 20 configured to receive at least the helmet 12 in operation. In the embodiment shown, the interior volume 20 receives the patient 11 as well, in a seated position. A chair 21 may therefore be provided, as necessary, either connected to and/or part of the frame 14 or as a separate, conventional chair. The frame 14 in this embodiment includes a base 22 supporting four main poles 24 connected together at their ends opposite to the base 22 by tie rails 26. The frame 14 further may include one or more connection rails 28. In the embodiment shown, some of the connection rails 28 are releasably attached at their ends to corresponding openings in the main poles 24. The connection rails 28 therefore may be configured for positional adjustment by repositioning on the frame 14 as needed to accommodate the height of the patient 11 or for compensating other factors. The connection rails 28 may be secured using mechanical fasteners, clips, or the like. In the embodiment shown, an additional connection rail 28 is provided at the top, secured to the tie rails 26. However, this configuration for the frame 14 is not limiting and other configurations and shapes for the frame 14 and placements of the connection rails 28 may be utilized while still keeping within the spirit and scope of the invention. In other embodiments, resistance bands 16 may be attached to other portions of the frame 14 besides a connection rail 28.

Figure 3:
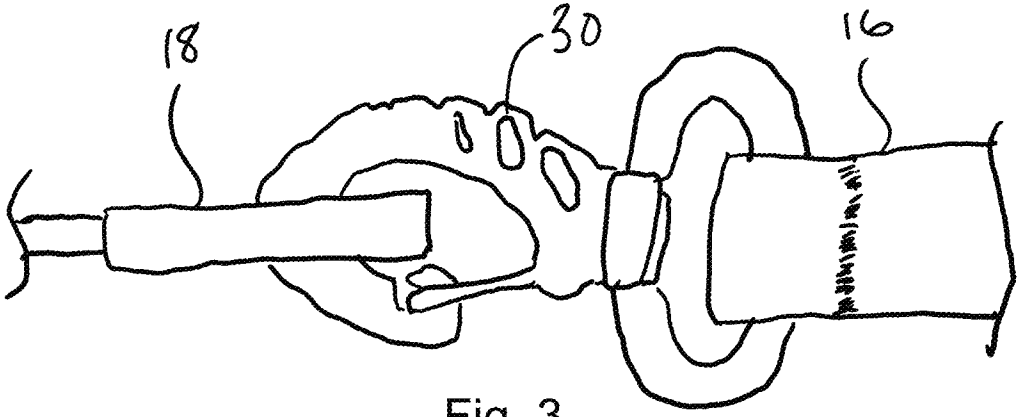
FIG. 3 is a partial, enlarged side elevational view of an example resistance band connection to an attachment anchor of the helmet of FIG. 1A.

The resistance bands 16 may be made from an elastic material and multiple resistance bands may differ in their elasticity, to allow for customization of exercise using the system 10. Each of the resistance bands 16 may have a first end that is selectively connectable to one of the attachment anchors 18 of the helmet 12 and an opposing second end that is selectively connectable to one of the connection rails 28 of the frame 14. The manner of attachment for each of the first and second ends of the resistance bands 16 may be the same (in which case either end of the resistance band 16 may be connected to an anchor 18 or a connection rail 28) or may be different from each other (such that one end can only be attached to an anchor 18 and vice versa, for example). Referring to FIG. 3, one method of connection is shown as a locking clip 30, in particular a spring-loaded carabiner clip, linked to a first end of the resistance band 16 that can be used to clip onto an attachment anchor 18 of the helmet 12. The same or similar locking clip 30 may also be used for attachment to a connection rail 28 of the frame 14. However, other methods of attachment, such as hooks, buckles, screws, other types of mechanical fasteners, or the like, may be used as well. In some embodiments, the resistance bands 16 may not have a connection device and may simply be tied onto the attachment anchor 18 and/or the connection rail 28.

Methods for performing cervical strengthening and rehabilitation on a patient are also encompassed by the present application. For example, the patient 11 may be provided with the helmet 12. Prior to wearing the helmet 12, where applicable, an appropriately sized removable interior lining 15 may be placed into the helmet 12 to match a skull size of the patient 11. The patient 11 may then be received within the interior volume 20 of the frame 14, preferably in a seated position, although in some embodiments it may be possible or desirable to have the patient 11 standing, reclining, or lying down. Positions of one or more of the connection rails 28 may be adjusted as necessary for attachment of the resistance band(s) 16.

The first end of a resistance band 16 may be attached to one of the plurality of attachment anchors 18 on the helmet 12 and the second end may be attached to one of the connection rails 28 of the frame 14. The process may be repeated for attaching additional resistance bands 16 to the helmet 12 and frame 14 depending on the exercises to be performed by the patient 11. The doctor or therapist can attach the resistance bands 16 in precise locations needed to isolate specific muscle groups for rehabilitation of a specific condition. In some instances, first ends of multiple resistance bands 16 may be attached to a common attachment anchor 18. For example, FIG. 5 shows two resistance bands 16 from opposite left and right sides of the frame 14 attached to the lower front side attachment anchor 18*a* near the patient's chin on the helmet 12. FIG. 5 also shows a resistance band 16 having its first end attached to an attachment anchor 18*e* located at the top side of the helmet 12. This attachment can be used to add a traction component to the exercise(s).

The order of the steps recited above is, for the most part, not critical. For example, the patient 11 may enter the frame 14 prior to being provided with or putting on the helmet 12. In another example, the ends of the resistance bands 16 may be attached to the helmet 12 or the frame 14 in any order. In still another example, one or more resistance bands 16 may already be attached to the frame 14 and/or to the helmet 12 prior to the patient 11 being provided with the helmet 12 and/or entering the frame 14. Such examples are non-limiting.

Once the patient 11 is wearing the helmet 12 within the frame 14 and appropriate resistance bands 16 are attached to the helmet 12 and frame 14, the patient 11 may be instructed to assume one or more head positions as part of a strengthening and/or rehabilitating exercise, some basic examples of which are described in further detail below.

For example, in a sitting position, the patient 11 may begin by assuming correct posture. Looking straight ahead, the patient 11 may tuck the chin slightly and aligns ears, shoulders, and hips. When the head is moved in an exercise, the patient 11 may be instructed to try to look just a little bit farther in the direction of movement than the head will move. This helps increase the range of motion. Three example treatment protocols are outlined below.

Stage 1 exercises are isometric exercises, where the force exerted by the neck muscles matches the resistance offered by the stretched resistance bands 16, and head movement does not occur. The patient's head is stationary and the therapist or physician will add the resistance bands 16 as needed. Stage 2 and 3 exercises are isotonic exercises, where the force exerted by the neck muscles overcomes resistance and head movement does occur. The patient's lower body and upper back are stationary with proper sitting posture. The head moves alone. None of these stages calls for heavy weight loading. The patient 11 benefits more by repetition than by increased resistance. The resistance applied should be less than the muscle is capable of overcoming. Resistance during an exercise can be varied if desired, by adding the resistance bands 16 to various points around the helmet 12. The "center position" used in each of the exercises below refers to a position with eyes forward and head straight.

1st Stage: The head does not move. The bands 16 are attached in preselected positions on the helmet 12 and the patient 11 holds the correct posture. Exercises are isometric exercises, where the force exerted by the neck muscles matches the resistance offered by the stretched bands and head movement does not occur. The patient's head and lower body remain stationary. Start with the head in the center position and look straight ahead. The doctor/therapist will add the lowest resistance band 16 to the helmet, while holding the head in the center position.

2nd Stage: The patient 11 moves the head in one direction and holds the position for a specified amount of time. Exercises are isotonic exercises, where the force exerted by the neck muscles overcomes resistance and head movement does occur. The patient's lower body is stationary and only the head moves. From the center position, after adding the desired resistance band 16, slowly turn the head as far as possible to the side opposite resistance. Look a little farther in the direction of movement than the head will move.

3rd Stage: Turn the head to the side opposite the resistance until it cannot go any further, hold for the desired amount of time. The therapist will add the desired resistance and slowly turn the head as far as possible to the side opposite the resistance band. Look a little farther in the direction of movement than the head will move. Repeat each exercise on each side of the neck. There will be no need to change the resistance bands 16 as they will all be attached in the various preset positions.

Embodiments of the system 10 described herein solve a number of technical problems as described below.

Limited Products That Address Cervical Strengthening or Rehabilitation: When visiting a physical therapist or chiropractor, the number of products they have available to them is extremely limited for cervical strengthening or rehabilitation. In addition, the cervical exercises they are likely to send a patient home with will likely not be performed because they are minimally effective and take extreme effort and persistence to achieve that minimal effect.

Ineffective Exercises: Exercises are not as precise when using just a headband around the top portion of the patient's skull. For example, there is no place to add tension to the lower jaw area—it is not as effective at reaching the upper neck musculature. To be truly effective, resistance must be added to multiple and various points around the entire skull and jaw area.

Uncomfortable/Avoidance or Non-Compliance with Treatment: All cervical exercise devices currently on the market attach around the top of the patient's skull, usually with some kind of headband. This is incredibly uncomfortable for the patient wearing the device and limiting for the types of exercises the patient is able to do. Moreover, discomfort may lead to performing exercise incorrectly, which can cause additional injury and will not help heal the condition.

Safety: Although resistance bands are very cost effective, versatile and easy to use, they can be very dangerous. Many people have neck pain and are looking for ways to alleviate their pain. A massive increase in eye injuries has been observed due to exercise bands. Many have done studies on this. One of these studies examined the relationship between eye injury and exercise bands. (Ocular Trauma Secondary to Exercise Resistance Bands During the Covid 19 Pandemic, Dec. 4, 2020). Some patients do not recover their vision after exercise band injuries. The helmet 12 offers superior safety should a band break for any reason. The helmet 12 may be equipped to endure high velocity projectiles, so a snapped resistance band 16 should cause little to no injury to the patient's eyes and face.

Productivity: With the system 10 described herein, a patient is able to do multiple exercises simultaneously, which can reduce the amount of time needed for exercises to be effective. In addition, the option to add traction to all or select exercises may be available. Existing products are only able to exercise one side of the cervical musculature at a time, without any traction of the cervical spine. The system 10 described herein can address multiple muscle groups simultaneously, while stabilizing the cervical spine. The weight of the helmet 12 itself may cause eccentric and concentric contractions of the paraspinal musculature and interior musculature simultaneously. The helmet 12 adds weight, which engages proprioception.

Effectiveness: As the patient is able to accomplish more in a shorter period of time, the patient will also have a much shorter recovery period from injury or chronic pain conditions. The doctor may be able to precisely pinpoint musculature to exercise based on the angle of the resistance bands 16. The doctor can direct exercises specific to patient injury or condition due to the adjustability of the frame 14 and multiple attachment points on the helmet 12.

Those skilled in the art will recognize that boundaries between the above-described operations are merely illustrative. The multiple operations may be combined into a single operation, a single operation may be distributed in additional operations and operations may be executed at least partially overlapping in time. Further, alternative embodiments may include multiple instances of a particular operation, and the order of operations may be altered in various other embodiments.

While specific and distinct embodiments have been shown in the drawings, various individual elements or combinations of elements from the different embodiments may be combined with one another while in keeping with the spirit and scope of the invention. Thus, an individual feature described herein only with respect to one embodiment should not be construed as being incompatible with other embodiments described herein or otherwise encompassed by the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A cervical strengthening and rehabilitation system comprising:

a helmet having a plurality of attachment anchors distributed at different locations thereon, the helmet having a lower jaw region configured to surround at least a portion of a lower jaw of the patient wearing the helmet, at least one of the plurality of attachment anchors being positioned on the lower jaw region of the helmet;

a frame defining an interior volume configured to receive the helmet in operation; and two or more resistance bands, each of the two or more resistance bands having a first end connected to one of the plurality of attachment anchors on the helmet and an opposing second end connected to the frame.

2. The system of claim 1, wherein the frame includes one or more connection rails configured to receive the second ends of the two or more resistance bands.

3. The system of claim 2, wherein at least one of the one or more connection rails is configured for positional adjustment.

4. The system of claim 1, wherein the helmet includes a removable interior lining.

5. The system of claim 4, wherein the helmet includes a plurality of removable interior linings, each of the interior linings accommodating a different skull size.

6. The system of claim 1, wherein each of the first and second ends of each of the two or more resistance bands includes a locking clip.

7. The system of claim 6, wherein the locking clip is a carabiner clip.

8. The system of claim 1, wherein the plurality of attachment anchors includes at least one attachment anchor positioned on a left side of the helmet, at least one attachment anchor positioned on a right side of the helmet, at least one attachment anchor positioned on a front side of the helmet, and at least one attachment anchor positioned on a rear side of the helmet.

9. The system of claim 8, wherein the plurality of attachment anchors further includes at least one attachment anchor positioned on a top side of the helmet.

10. The system of claim 1, wherein the plurality of attachment anchors are eye bolts.

11. The system of claim 1, wherein the helmet further includes a transparent protective visor configured to cover eyes of a patient wearing the helmet.

12. A method for performing cervical strengthening and rehabilitation on a patient, the method comprising:

providing the patient with a helmet having a plurality of attachment anchors distributed at different locations thereon, the helmet having a lower jaw region configured to surround at least a portion of a lower jaw of the patient wearing the helmet, at least one of the plurality of attachment anchors being positioned on the lower jaw region of the helmet;

receiving the patient within an interior volume defined by a frame;

attaching a first end of a first resistance band to one of the plurality of attachment anchors on the helmet and an opposing second end of the first resistance band to the frame;

attaching a first end of a second resistance band to one of the plurality of attachment anchors on the helmet and an opposing second end of the second resistance band to the frame; and instructing the patient to assume a first head position while wearing the helmet and while the first resistance band and the second resistance band are attached to the helmet and the frame.

13. The method of claim 12, wherein the frame includes one or more connection rails, and attaching the second ends of the first and second resistance bands to the frame includes attaching the second ends of the first and second resistance bands to one of the one or more connection rails.

14. The method of claim 13, further comprising adjusting a position of the one of the one or more connection rails to which the first ends of the first and second resistance bands are attached.

15. The method of claim 12, wherein the first ends of the first and second resistance bands are attached to a common one of the plurality of attachment anchors on the helmet.

16. The method of claim 12, wherein the first end of the first resistance band is attached to an attachment anchor on a top side of the helmet and the first end of the second resistance band is attached to an attachment anchor on a side of the helmet different from the top side.

17. The method of claim 12, further comprising adjusting the helmet according to a skull size of the patient by placing a selected one of a plurality of differently sized removable interior linings into the helmet.

18. The method of claim 12, further comprising instructing the patient to assume a second head position different from the first head position while wearing the helmet and while the first resistance band and the second resistance band are attached to the helmet and the frame.

* * * * *